United States Patent [19]

Aoyagi et al.

[11] Patent Number: 4,907,646

[45] Date of Patent: Mar. 13, 1990

[54] HEAT EXCHANGER

[75] Inventors: Osamu Aoyagi, Otsu; Shoichi Yokoyama, Shiga; Hirotada Kaneko, Kusatsu; Eiji Nakatsuno, Otsu; Shotaro Ito, Shiga, all of Japan

[73] Assignee: Matsushita Electric Industrial Co., Ltd., Osaka, Japan

[21] Appl. No.: 262,821

[22] Filed: Oct. 26, 1988

[30] Foreign Application Priority Data

Oct. 30, 1987 [JP] Japan ..... 62-276101
Oct. 30, 1987 [JP] Japan ..... 62-276102
Feb. 21, 1988 [JP] Japan ..... 63-11152

[51] Int. Cl.[4] ..... F28D 1/04
[52] U.S. Cl. ..... 165/151
[58] Field of Search ..... 165/151, 152

[56] References Cited

U.S. PATENT DOCUMENTS 4,691,767 9/1987 Tanaka ..... 165/151

FOREIGN PATENT DOCUMENTS 57-139086 8/1982 Japan .
59-26237 6/1984 Japan .
61-202092 9/1986 Japan .
61-217695 9/1986 Japan .
62-34676 2/1987 Japan .
61-38152 9/1987 Japan .

*Primary Examiner*—Robert G. Nilson
*Attorney, Agent, or Firm*—Stevens, Davis, Miller & Mosher

[57] ABSTRACT

A heat exchanger has groups of cutouts provided on tabular fin surfaces, projecting in the direction of arrangement of the fins. Each of the cutouts has two opposed openings in the main direction of air flow as well as two leg portions that not parallel with the main direction of air flow, the cutouts being formed on the tabular fin surfaces alternately on the front and rear sides with a fin base portion placed therebetween. The heat exchanger substantially reduces heat resistance between the air and the fin surfaces and ventilation resistance when the humidity is high, and excels in noise characteristics since the configuration of each cutout provided on the fin surface on the air inlet side of a cross flow fan is changed.

8 Claims, 13 Drawing Sheets

HEAT EXCHANGER

BACKGROUND OF THE INVENTION

The present invention relates to a heat exchanger which is used in an air-conditioner, a refrigerator or the like and indirectly effects transfer of heat between two fluids.

As shown in FIG. 1, a conventional heat exchanger of this type comprises heat transfer tubes 2 made of copper or the like and connected to each other by means of U-bends, fins 1 made of aluminum or the like, and so forth, wherein heat exchange is carried out by a fluid passing through the tubes 2 and air which flows among fins 1 in the direction of the arrow.

Such a heat exchanger has come to be required to be compact and to possess high performance. However, in view of such problems as noise, the rate of flow among the fins 1 is restrained to a low level, and, as compared with the heat resistance of the tube interior side, the heat resistance of the fin surfaces side is extremely high. For that reason, a difference in heat resistance between both sides is reduced by expanding the areas of the fins 1. Nevertheless, there are limits to expanding the surface areas of the fins 1, and, at present, the heat resistance of the fin surface side is still substantially greater than the heat resistance of the tube interior side.

For this reason, in recent years, an attempt has been made to reduce the heat resistance between air and the fins by working on the fin surfaces.

FIG. 2 is a top plan view of a conventional example of improvement. In the drawing, reference numeral 1 denotes a fin; 2, a heat transfer tube; and 3, a fin base. Reference numerals 105, 106, 115, 116, 125 and 126 denote rising portions; 107, 117 and 127, transverse portions; and 104, 114 and 124, cutouts. Reference character R denotes a gas passage; A, air; and l, a center line of an air passage.

The heat exchanger shown in FIG. 2 uses the fin 1 in which the cutouts 104, 114 and 124 formed by causing the transverse portions 107, 117 and 127 to span the pairs of the rising pieces 105 and 106, 115 and 116, and 125 and 126 across the air passage R between fin collars 12 for the heat transfer tubes 2 which are disposed adjacent to each other. The cutouts 104, 114 are disposed on the air flow inlet side and the air flow outlet side, and are separated from each other in the direction of a row thereof. On the other hand, the cutouts 104 are disposed between the aforementioned two sides and are not divided. Further, the angle of inclination of the rising portions 105, 106, 115, 125 of the cutouts 104, 114, 124 on the heat transfer tube 2 side is set in such a manner as to surround the outer peripheries of the respective heat transfer tubes 2, while the remaining rising pieces 116, 126 have an angle of inclination with respect to the center line l of the air passage. At the same time, between the cutouts 114, 124 on the air flow inlet side and the cutouts 114, 124 on the air flow outlet side, the directions of inclination of the rising pieces 116, 126 are arranged to be opposite to each other. As the air flows along these rising portions 116, 126, the mixing of the air A passing through the air passage R is accelerated, so that it is possible to improve the heat exchange efficiency.

However, the effect of mixing the air A in the finned heat exchanger using the fins shown in FIG. 2 is not derived from only the fact that the air flows along the rising portions 116, 126, so that it has not been possible to improve the heat exchange efficiency remarkably.

The above-described arrangement is disclosed in Japanese Utility Model Unexamined Publication No. 57-139086.

There have been proposed many improvements to enhance the efficiency of the heat exchanger other than the above-described one, and some of them will be described below.

For instance, Japanese Patent Examined Publication No. 59-26237, Japanese Patent Unexamined Publication No. 61-217695 and Japanese Utility Model Unexamined Publication No. 62-34676 disclose an arrangement in which rectangular cutouts are arranged under a certain condition. In addition, Japanese Utility Model Examined Publication No. 62-38152 discloses an arrangement in which trapezoidal cutouts having different sizes and equal legs are arranged.

However, with the former arrangement, since the rising portions of the cutouts project parallel with the direction of the air flow, the action of disturbing the air flow passing among the fins is lacking, so that it is impossible to expect an effect of improving the heat transfer capabilities based on the action of turbulence.

On the other hand, with the latter arrangement, since all the adjacent rising portions are located parallel with each other, it is possible to vary the direction of the air flow, but the action of disturbing the air flow is small, so that it is still impossible to expect the effect of improving the heat transfer capabilities based on the action of turbulence.

SUMMARY OF THE INVENTION

Accordingly, a primary object of the present invention is to provide a heat exchanger which is capable of generating turbulence at a front end portion of a tabular fin where a gas flows, thereby improving the heat transfer capabilities.

Another object of the present invention is to provide a heat exchanger which is capable of generating turbulence at a rear end portion of a tabular fin as well where a gas flows, thereby further improving the heat transfer capabilities.

A further object of the present invention is to provide a heat exchanger which is capable of restraining the level of noise occurring at a rear end portion of a tabular fin where a gas flows.

A further object of the present invention is to provide a heat exchanger which is provided with a plurality of rows of heat transfer tubes and is capable of improving the heat transfer capabilities in front rows and of controlling the noise in rear rows.

A still further object of the present invention is to provide a heat exchanger which is provided with a plurality of rows of heat transfer tubes and is capable of generating turbulence more reasonably, further improving the heat transfer capabilities and controlling the noise.

In accordance with the present invention, there is provided a heat exchanger having a plurality of tabular fins which are arranged in parallel at fixed intervals and through which the air is allowed to flow and a plurality of tubes which are inserted in each of the tubular fins at a right angle therewith and disposed perpendicular to the direction of air flow (in the direction of arrangement of the fins) and through which a fluid is allowed to flow, a group of cutouts being formed on tabular fin surfaces and between adjacent those of the fins, projecting in the direction of arrangement of the fins, wherein: the group of cutouts are divided into an upstream-side subgroup and a downstream-side subgroup, as viewed in the direction of the air flow, with a line passing through the center of each of the tubes serving as a boundary therebetween, and a central flat portion is provided which is located on the center line and between the upstream-side subgroup and the downstream-side subgroup; the upstream-side subgroup of cutouts include three rows of cutouts which are disposed on a central side located close to the center line, on an outer side located on the upstream side, and on an intermediate side located between the central side and the outer side; each of the cutouts in each of the rows is formed by a pair of rising portions whose ends project from the fin surface as well as a bridging portion spanning the rising portions, the cutouts being formed such as to project alternately on the front side and the rear side of the fin surface; an intermediate flat portion is formed between adjacent those of the cutouts, the cutouts being arranged parallel with each other with the intermediate flat portion placed therebetween; each of the rising portions which are adjacent to the tubes among the rising portions of the cutouts is located on a line substantially parallel with a line tangential to an outer periphery of the tube; each of the cutouts on the central side and the intermediate side is formed into the shape of a trapezoid with equal legs, two parallel sides thereof being perpendicular to the main direction of the air flow, the short side of each of the trapezoids with equal legs being arranged such as to be located on the center line side; a pair of parallelogrammic medium-size cutouts which are obtained by separating a cutout having the shape of the trapezoid with equal legs into two, and which are provided with a dividing flat portion in the intermediate side constitute the above-mentioned outside cutouts; the rising portions of the pair of medium-size cutouts that are respectively disposed on both sides of the dividing flat portion are oriented in such a manner that an interval therebetween becomes smaller toward the leeward side in the main direction of air flow; and the leeward-side subgroup of cutouts includes a plurality of cutouts.

The above objects, features and advantages of the present invention will become more apparent from the following detailed description of the invention when read in conjunction with the accompanying drawings.

DESCRIPTION OF THE PREFERRED EMBODIMENTS

A finned heat exchanger in accordance with a first invention will be described with reference to FIGS. 3 and 4.

Figure 3:
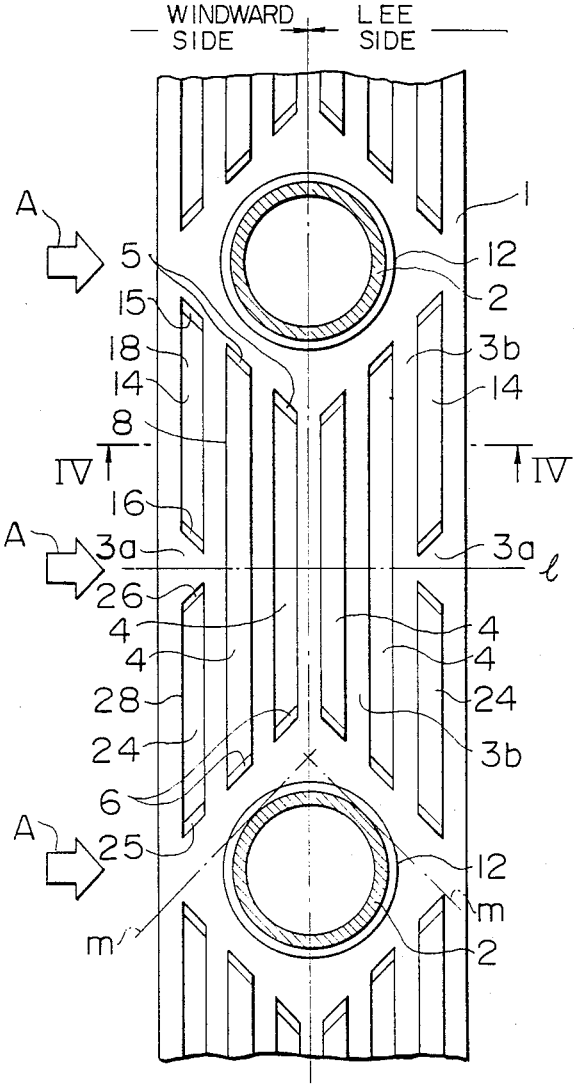
FIG. 3 is a top plan view of a heat exchanger embodying a first invention, illustrating a group of cutouts formed in a fin.
Figure 4:
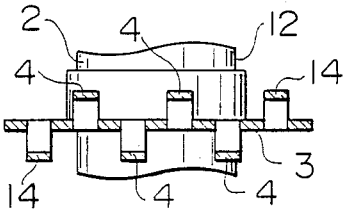
FIG. 4 is a cross-sectional view taken along the line IV—IV of FIG. 3.

As shown in FIG. 3, transfer tubes 2 are respectively inserted into fin collars 12 formed by burring in a tabular fin 1 at a fixed interval, and a gas flows in the direction of the arrows A.

The fin 1 has a group of cutouts comprising a total of six rows of cutouts, i.e., three on the windward side and another three on the leeward side of the air flow A, between the two heat transfer tubes 2 that are arranged adjacent to each other in a direction perpendicular to the air flow A (this perpendicular direction being hereafter referred to as the direction of a column). Among the six rows of cutouts, both cutouts located at the most upstream end of the air flow and the most downstream end thereof are composed of two cutouts 14, 24 which are respectively separated by a dividing flat portion 3*a*, while the cutouts in the other rows are respectively constituted by single cutouts 4. Openings 8, 18, 28 of the six rows of cutouts are perpendicular to the main flow l of the air. Respective rising portions 5, 6, 15, 25 of the cutouts 4, 14, 24 on the heat transfer tube 2 side has their angles of inclination set in such a manner as to extend substantially parallel with a tangential line m of an outer periphery of the heat transfer tube 2. On the other hand, rising portions 16, 26 of the two cutouts 14, 24 that are located on the central portion side and at the upstream or downstream end of the air flow are parallel with the rising portions 15, 25, respectively, the rising portions 14, 24 being formed as parallelograms. In addition, as shown in FIG. 4, the six rows of the cutouts are cut out alternately on the obverse and reverse sides of the fin 1 with each intermediate flat portion 3*b* placed therebetween.

In accordance with the above-described arrangement, it is possible to obtain the following advantages: (1) The six rows of the cutouts and the intermediate flat portions 3*b* located between two adjacent those thereof respectively display the effect of a front edge of a boundary; (2) the air flow along the heat transfer tube 2 is facilitated by the rising portions 5, 6, 15, 25 on the side of the heat transfer tube 2, thereby displaying the effect of a reduced dead water region; and (3) a rotational component is generated in the air flow in the directions of the inclination of the rising portions 16, 26 of the upstream end and lower stream end of the air flow on the side of the central portion, thereby accelerating the effect of mixing the air flow and the turbulence effect.

Due to these various types of effects, it is possible to remarkably improve the heat transfer rate between the air and the fin surfaces, thereby substantially improving the heat exchange efficiency.

Referring now to FIGS. 5 to 9, a description will be given of the finned heat exchanger in accordance with a second embodiment of the present invention.

Figure 5:
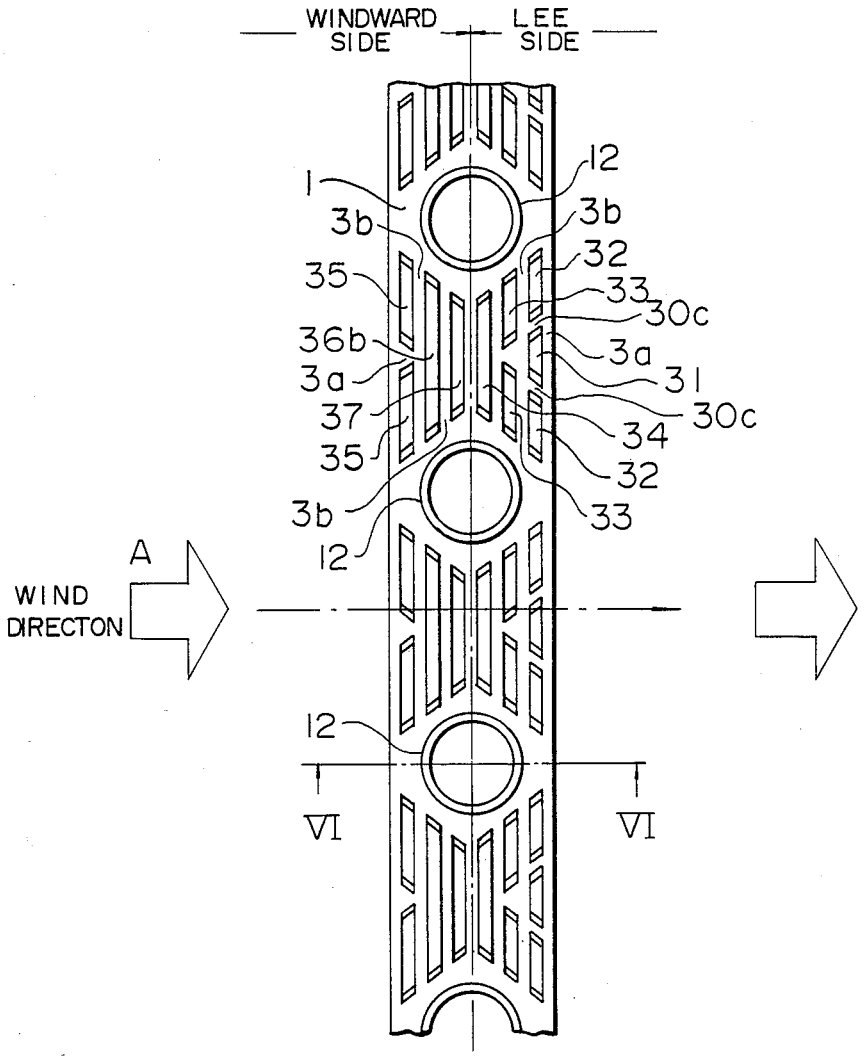
FIG. 5 is a top plan view of a heat exchanger embodying a second invention, illustrating a group of cutouts formed in the fin.
Figure 6:
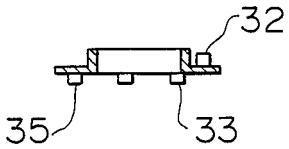
FIG. 6 is a cross-sectional view taken along the line VI—VI of FIG. 5.

As shown in FIG. 5, this embodiment is identical with the first embodiment in that each heat transfer tube is inserted in the fin collar 12 formed by burring in the tabular fin 1 at fixed intervals, and that the air flow takes place in the direction of the arrow A.

The configuration of the cutouts shown in FIG. 5 will be described. Each group of cutouts comprises six rows of cutouts which are arranged perpendicular to the main direction l of the air flow and are disposed with intermediate flat portions 3*b* provided on both sides thereof at equal intervals therebetween. A pair of cutouts 35 in the first row as viewed from the upstream side of the air flow comprise a pair of parallelogrammically-shaped slits that are obtained by separating a trapezoidal cutout with equal legs whose long side is the air inlet side, into two with the dividing flat portion 3*a* provided therebetween. Cutouts 36, 37 in the second and third rows as viewed from the upstream side of the air flow comprise slits that are respectively similar to the aforementioned trapezoidal cutout with equal legs. A pair of cutouts 33 in the fifth row comprise a pair of parallelogrammically-shaped slits that are obtained by separating a trapezoidal cutout whose short side is the air inlet side, into two with the dividing flat portion 3*a* provided therebetween. Three cutouts 31, 32, 32 in the sixth row comprise a parallelogrammically-shaped slit which is disposed downstream of the dividing flat portion 3*a* between the pair of cutouts 33 in the fifth row and whose short side is the air inlet side, as well as two parallelogrammically-shaped slits disposed on both sides of that slit with a small dividing flat portion 30*c* provided therebetween. In addition, the rising portions of the cutouts in the vicinity of the heat transfer tube have angles of inclination in directions of lines extending parallel with lines tangential to the outer periphery of the heat transfer tube, in the same way as the first embodiment.

Figure 1:
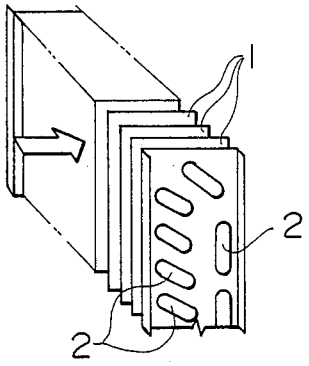
FIG. 1 PRIOR ART
FIG. 1 is a schematic perspective view of the structure of a conventional finned heat exchanger.
Figure 2:
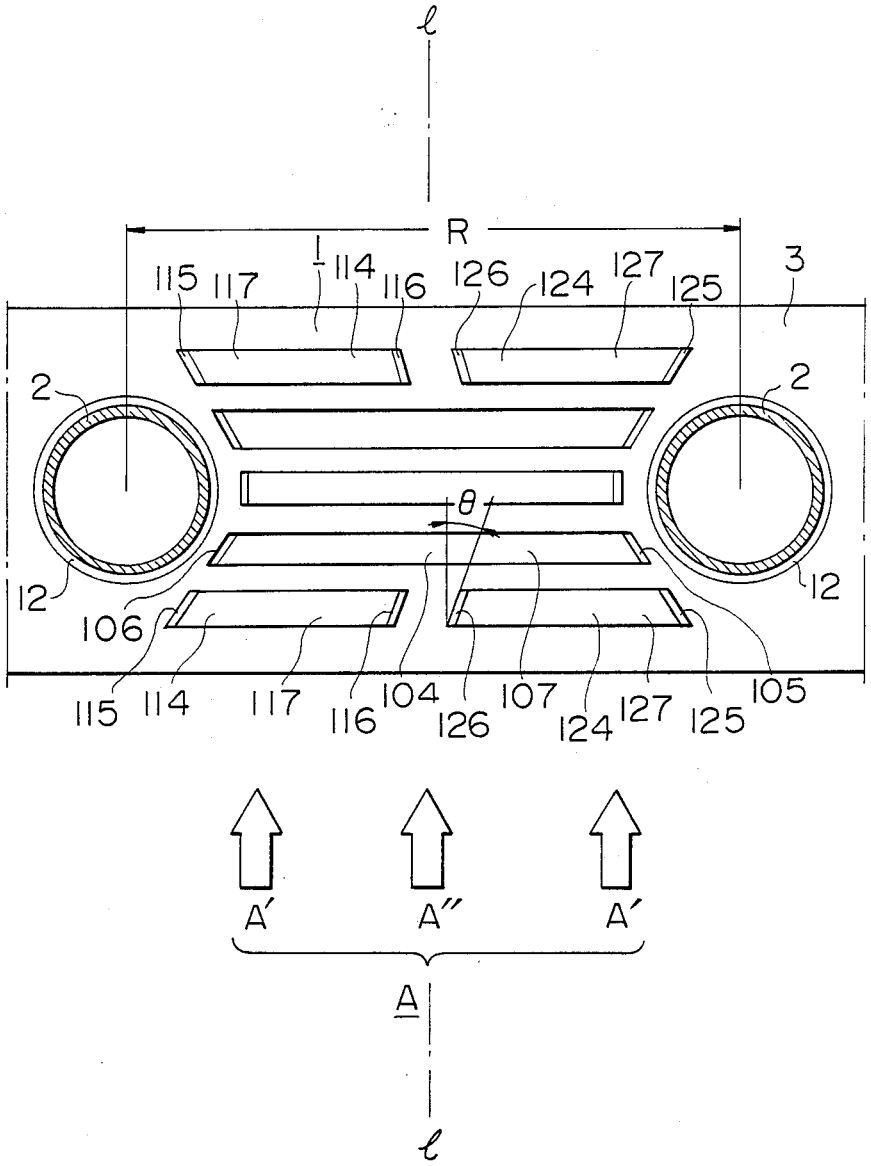
FIG. 2 PRIOR ART
FIG. 2 is a top plan view of a conventional example of a heat exchanger, illustrating a group of cutouts formed in a fin.

A heat exchange 40, in which a plurality of tabular plates each having the above-described arrangement are superposed on each other and which is arranged as shown in FIG. 1, is disposed, together with a blower 39, in an air passage 40*c* formed in a body 38 having an air inlet 40*a* and an air outlet 40*b*. Since this basic arrangement is already known excluding the pattern of the cutouts provided on the fin 1, a detailed description thereof will be omitted.

In accordance with the above-described arrangement, the following advantages can be obtained:

(1) The cutouts 35, 36, 37, 34, 33, 32, 32 in the six rows and intermediate flat portions 3*a* therebetween respectively display the effect of a front edge of a boundary layer. (2) The air flow along the heat transfer tubes is facilitated by the inclination of the rising portions of the cutouts in the vicinity of the heat transfer tubes, thereby demonstrating the effect of a reduced dead water region. (3) A rotating component is generated in the air flow by virtue of the inclination of the rising portions of the cutouts 35 with the dividing flat portion 3*a* provided therebetween at the upstream end of the air flow, thereby accelerating the effect of mixing the air flow and the turbulence effect. (4) Since the patterns of the cutouts on the air inlet side (upstream side) and the outlet side (downstream side) are varied and made asymmetrical about a line passing through the centers of the heat transfer tubes, the pattern on the upstream side is made simpler than that on the downstream side. Accordingly, it is possible to restrain the drawback that, even if waterdrops adhere to the fin surfaces when the humidity is high, the surface tension of the waterdrops causes the water drops to bridge between the adjacent cutouts 35 and between the cutouts 35 and 36, thereby increasing the ventilating resistance.

Figure 7:
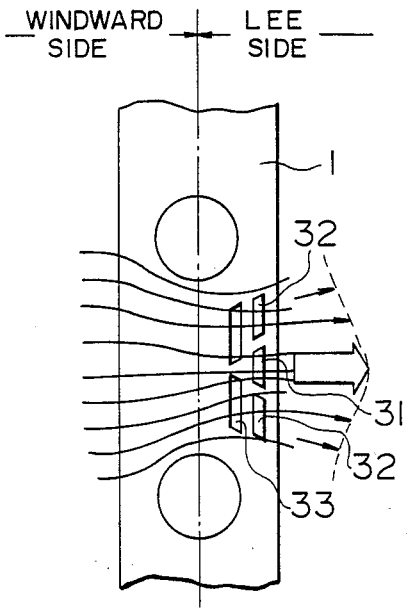
FIG. 7 is a diagram of distribution of wind volume in the group of cutouts shown in FIG. 5.
Figure 8:
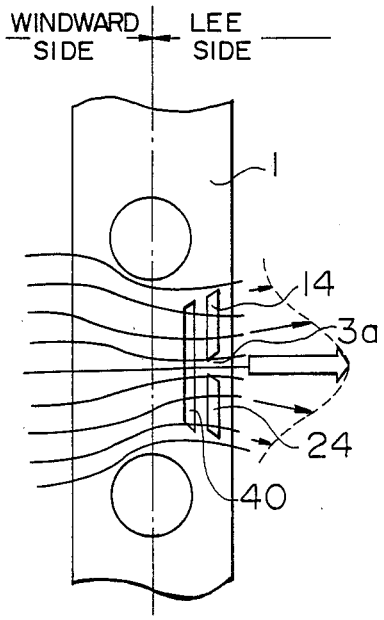
FIG. 8 is a diagram of distribution of wind volume in the group of cutouts shown in FIG. 3.

Referring now to FIGS. 7 and 8, description will be given of the fact the noise characteristics excel in comparison with the first embodiment.

If the downstream-side pattern is made complicated, as shown in FIG. 7, the difference in the wind velocity distribution can be kept to a small level by means of the cutouts 31, 32 on the side of the lowermost stream, so that the noise can be reduced.

On the other hand, in the case of the arrangement shown in FIG. 8, the difference between the velocity of the air which has passed through the cutouts 14, 24 on the most leeward side and the velocity of the air which has passed through the divided flat portions 3*a* is large, so that the wind velocity distribution characteristics are not stable, constituting a large factor generating the noises.

Figure 9:
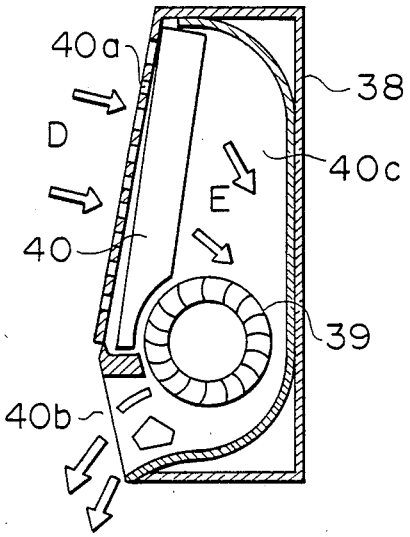
FIG. 9 is a cross-sectional view of an air-conditioner incorporating the heat exchanger in accordance with the present invention.

Accordingly, if the heat exchanger 40 in accordance with the second embodiment is incorporated in the air-conditioner (room side), as shown in FIG. 9, variations in the wind velocity distribution are alleviated on the outlet side of the air flow (E side), as shown in FIG. 7, making it possible to obtain an air-conditioner excelling in the noise characteristics.

In the foregoing first and second embodiments, a description has been given of a case where the heat transfer tubes are arranged in a row.

However, the first and second embodiments can be similarly implemented in the case where the heat transfer tubes are arranged in two rows in the main direction l of the air flow.

Figure 10:
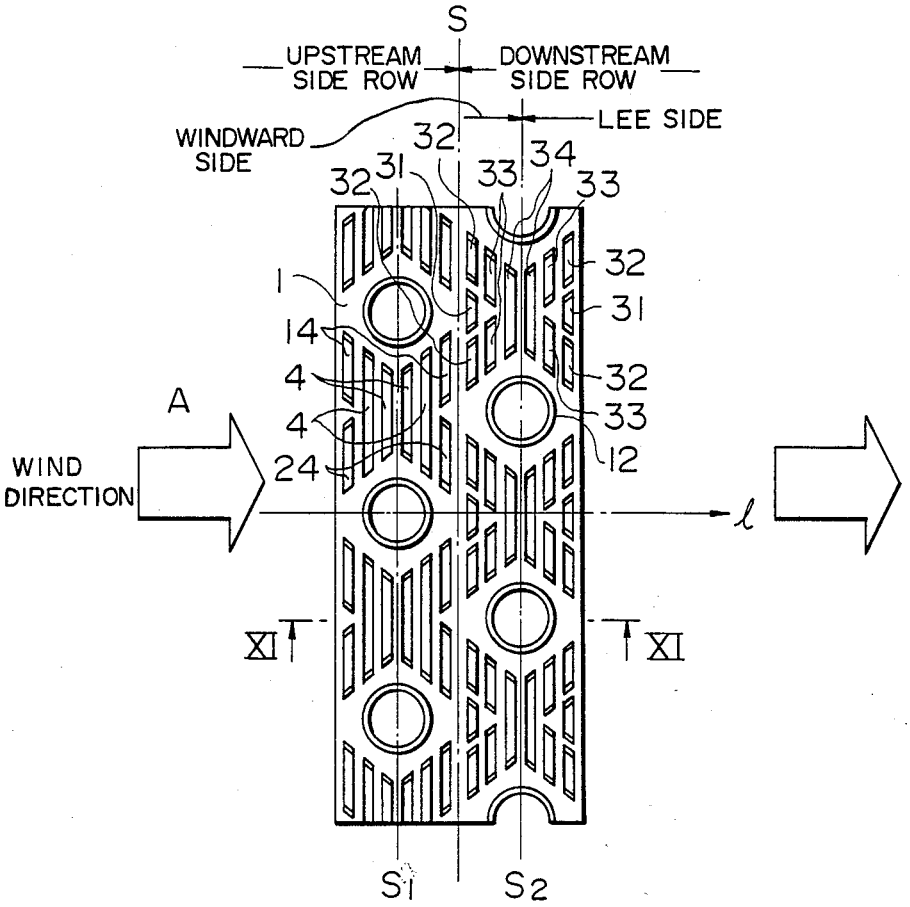
FIG. 10 is a top plan view of the group of cutouts formed in the fin of a heat exchanger in accordance with a third invention.
Figure 11:
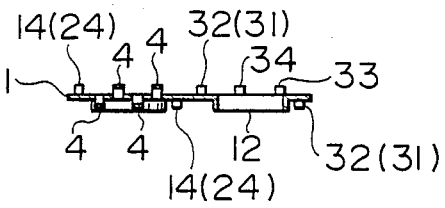
FIG. 11 is a cross-sectional view taken along the line XI—XI of FIG. 10.

Referring now to FIGS. 10 and 11, a description will be given of the configuration of the cutouts provided on the tabular fin 1.

The fin 1 is divided into an upstream-side row portion and a downstream-side row portion with a center line S serving as a boundary therebetween. There are provided fin collars 12 which heat transfer tubes penetrate in the direction of the stages in the respective row portions. These fin collars 12 are arranged in such a manner that the upstream-side rows and the downstream-side rows do not overlap in the direction of the air A.

In the upstream-side rows, groups of fins formed between adjacent those of the heat transfer tubes are groups of cutouts of the first embodiment shown in FIG. 3, and the cutouts 4, 14, 24 which are symmetrical about a center line $S_1$ passing through the centers of the heat transfer tubes are formed.

In the downstream-side rows, the groups of fins formed between the adjacent those of the heat transfer tubes are arranged as described below.

In other words, on the leeward side with a center line $S_2$ passing through the centers of the heat transfer tubes are the same as the groups of cutouts 32, 33, 34 formed on the leeward side in the second embodiment shown in FIG. 5, and the cutouts disposed windward of the center line $S_2$ are arranged such as to be symmetrical with those disposed on the leeward side about the center line $S_2$.

Accordingly, in the third embodiment as well, it is possible to obtain the same meritorious effects as those described in items (1) to (4) in connection with the second embodiment.

Figure 12:
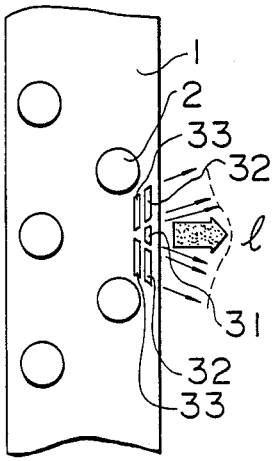
FIG. 12 is a graph illustrating the distribution of wind volume in the group of cutouts shown in FIG. 10.
Figure 13:
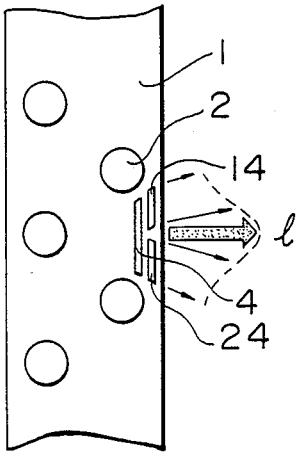
FIG. 13 is a graph illustrating the distribution of wind volume in a case where the group of cutouts shown in FIG. 3 are used on the leeward side.

Furthermore, as described in connection with FIGS. 7 and 8, the wind velocity distribution can be obtained on a stable basis, as shown in FIG. 12, by means of the groups of the cutouts disposed on the leeward side in the downstream-side rows. Hence, it is possible to effect a reduction in noises as compared with the heat exchanger having a sparse wind velocity distribution such as the one shown in FIG. 13.

The present inventor conducted a comparative experiment with a heat exchanger in which the groups of fins described in the first and second embodiments were combined, so as to ascertain the performance of the heat exchanger having the arrangement shown in FIGS. 10 and 11.

Figure 14:
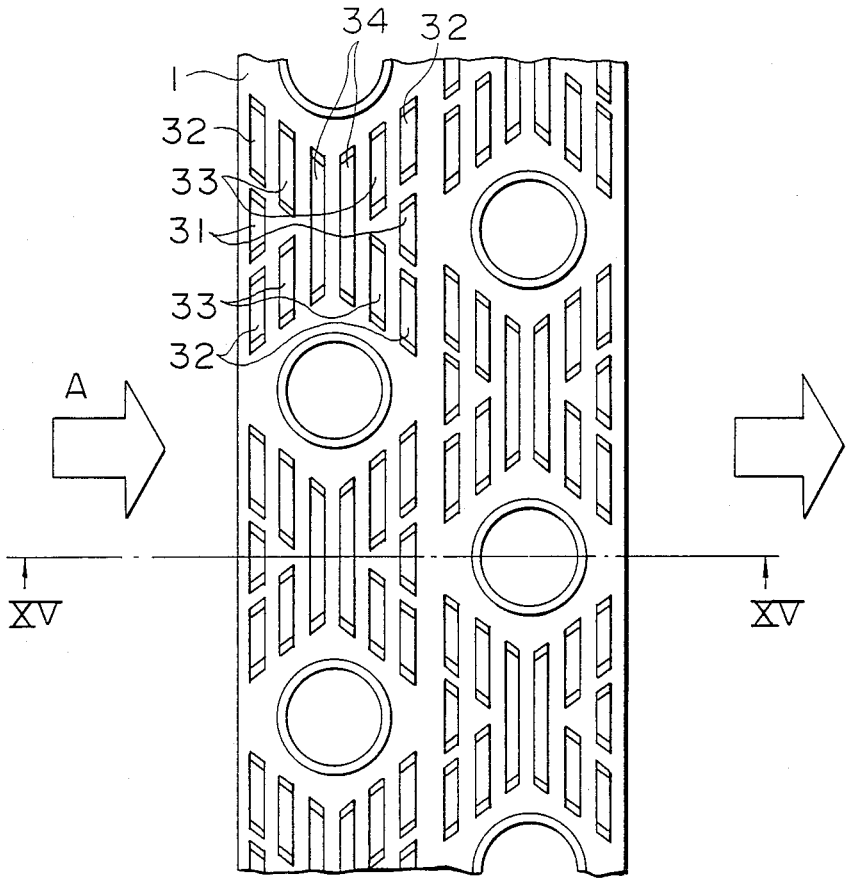
FIG. 14 is a top plan view of a group of fins which are used as a specimen for evaluating the performance of the heat exchanger in accordance with the third invention.
Figure 15:
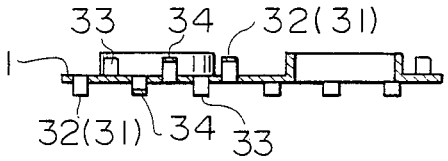
FIG. 15 is a cross-sectional view taken along the line XV—XV of FIG. 14.
Figure 16:
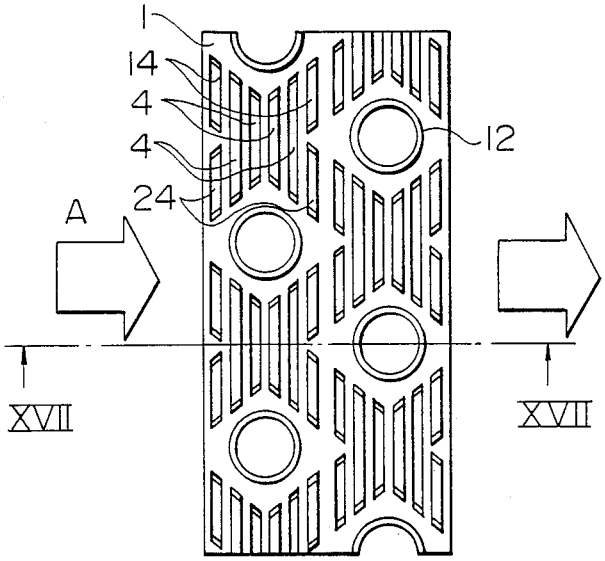
FIG. 16 is a top plan view of a different group of fins which are used as a specimen for evaluating the performance of the heat exchanger in accordance with the third invention.
Figure 17:
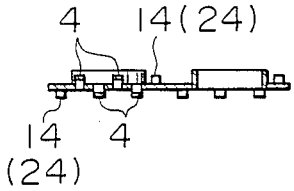
FIG. 17 is a cross-sectional view taken along the line XVII—XVII of FIG. 16.

The heat exchangers subjected to the experiment included the following three types: one having the arrangement shown in FIGS. 10 and 11; another in which groups of fins are used in which all the groups of cutouts disposed on the upstream- and downstream-side rows such as those shown in FIGS. 14 and 15 are used as the downstream-side rows shown in FIG. 10; and another in which groups of fins are used in which all the groups of cutouts on the upstream- and downstream-side rows such as those shown in FIGS. 16 and 17 are used as the upstream-side rows in FIG. 5 or 10.

Figure 18:
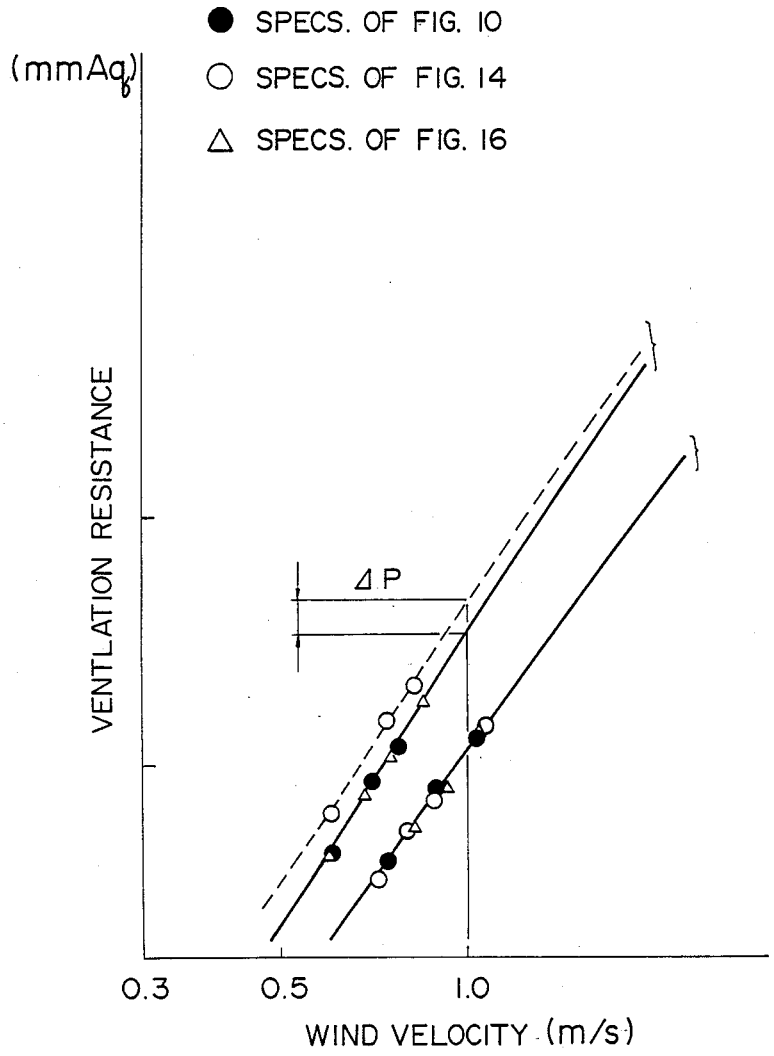
FIG. 18 is a characteristic diagram showing the relationships between wind velocity and ventilation characteristics, illustrating test results of the heat exchangers shown in FIGS. 10, 14, and 16, respectively.
Figure 20:
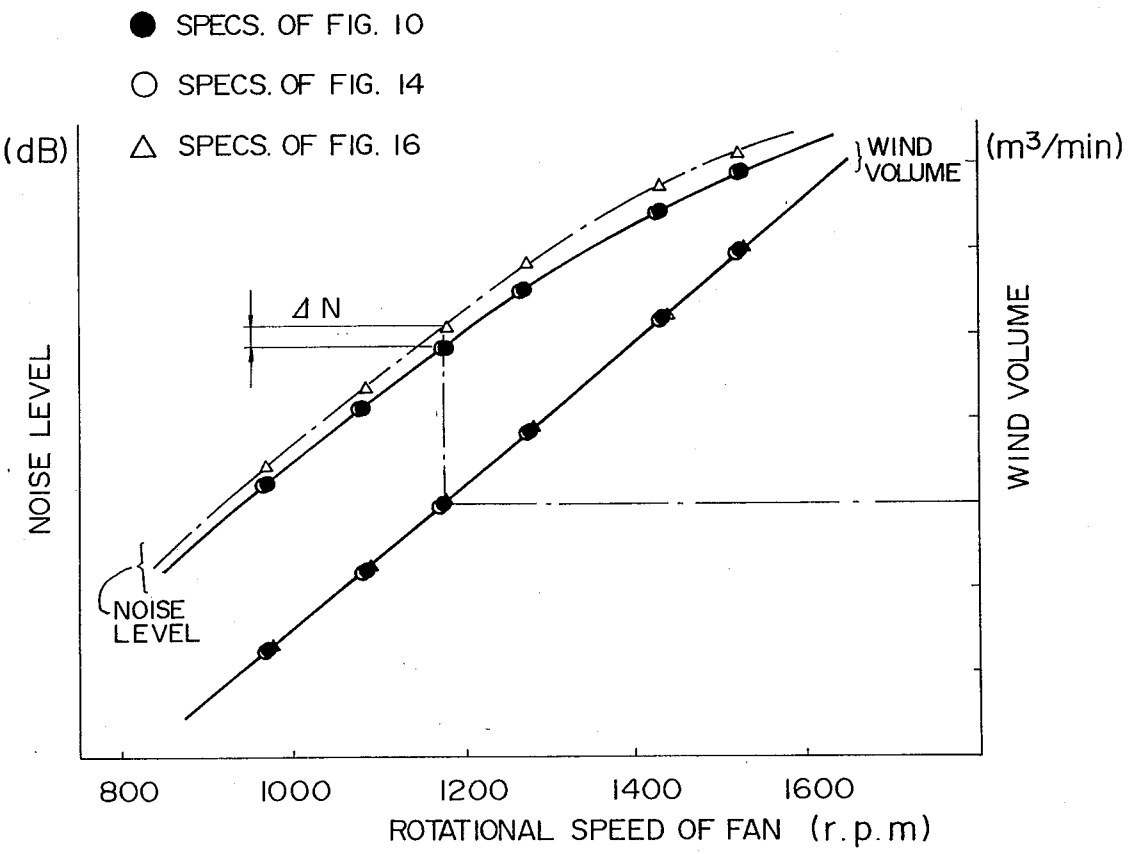
FIG. 20 is a characteristic diagram showing the relationships between the rotational speed of a fan and noise, illustrating test results of the heat exchangers shown in FIGS. 10, 14, and 16, respectively.

The results of the experiment are shown in FIGS. 18 and 20.

Figure 19:
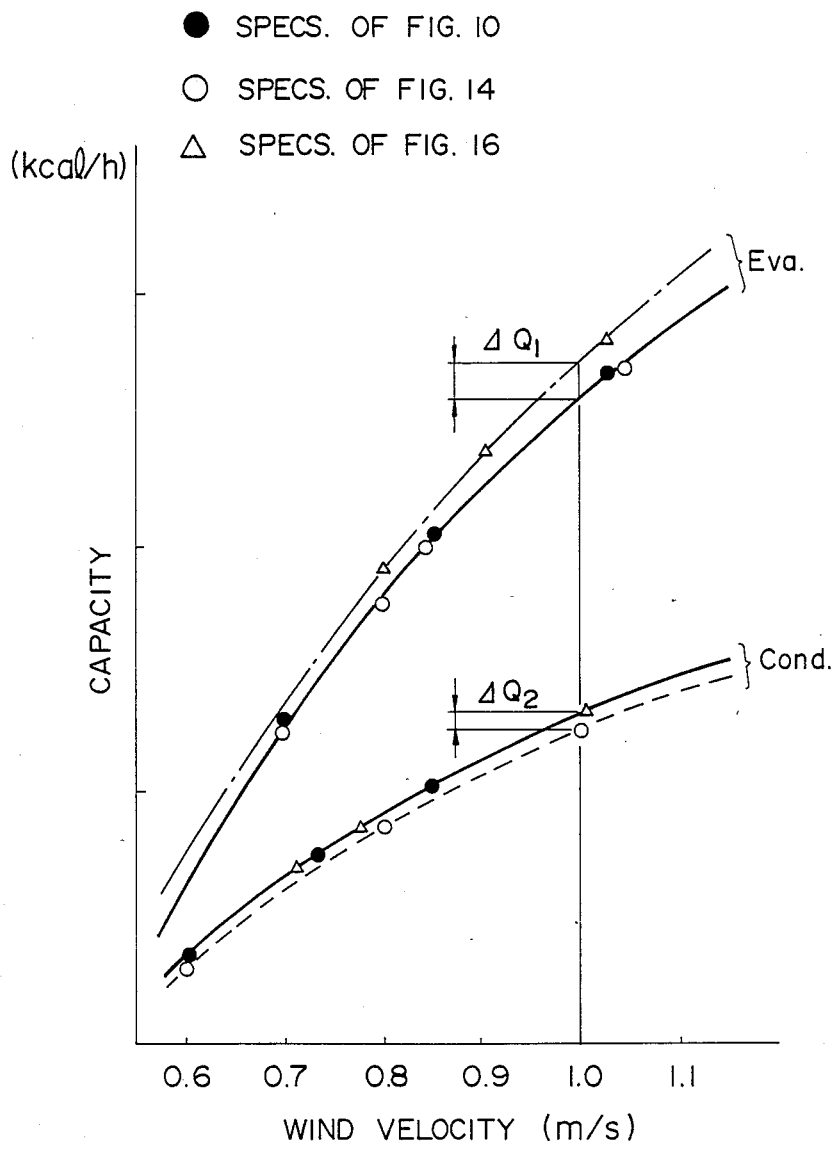
FIG. 19 is a characteristic diagram showing the relationships between wind velocity and performance, illustrating test results of the heat exchangers shown in FIGS. 10, 14, and 16, respectively.

FIG. 18 shows the relationships between the wind velocity and the ventilation, FIG. 19 shows the relationships between the wind velocity and the performance, and FIG. 20 shows the relationships between the rotational speed of a fan and the noise. With respect to the characteristics shown in FIGS. 18 and 19, the results are also described for the use of the heat exchangers on the condenser (Cond.) side and the evaporator (Eva.) side, respectively. FIG. 20 shows the results in a state in which the refrigerant was not allowed to flow. Namely, if the refrigerant is allowed to flow, the noise of the refrigerant affects the value of the noise, making it impossible to obtain accurate characteristic values.

As a result of the experiment shown in FIGS. 18, the three heat exchangers shown in FIGS. 10, 14 and 16, when used as the condenser, displayed substantially equivalent ventilation resistance performance, but, when used as the evaporator, the two heat exchangers shown in FIGS. 10 and 16 displayed favorable results.

In addition, as a result of the experiment shown in FIG. 19, when, used as the condenser, the two units shown in FIGS. 10 and 14 were slightly inferior to the one shown in FIG. 16, but, when, used as the evaporator, the two units shown in FIGS. 10 and 16 displayed slightly better performance than the one shown in FIG. 14.

Furthermore, as a result of the experiment shown in FIG. 20, under a condition where the same wind volume can be obtained, the two units shown in FIGS. 10 and 14 exhibited a slightly lower noise level than the one shown in FIG. 16, and their noise characteristics were excellent.

If the above-described experiments are summarized and if the performance of the heat exchanger in accordance with the present invention is 100, the overall evaluation is shown in the following table.

| Items of Comparison | Specs. of FIG. 10 | Specs. of FIG. 14 | Specs. of FIG. 16 |
|---|---|---|---|
| Cond Q | 100 | 100 | 102 |
| dP | 100 | 100 | 100 |
| Eva Q | 100 | 98 | 100 |
| dP | 100 | 114 | 100 |
| Noise | 100 | 100 | 103 |

Consequently, it can be seen that the heat exchanger in accordance with the third embodiment using the configuration of the cutouts shown in FIG. 10 has a low ventilation resistance and excellent noise characteristics, and is the most balanced heat exchanger among the above-described three types as a heat exchanger for use in an air-conditioner.

What is claimed is:

1. A heat exchanger having a plurality of tabular fins which are arranged in parallel at fixed intervals and through which the air is allowed to flow and a plurality of tubes which are inserted in each of said tabular fins at a right angle therewith and disposed perpendicular to the direction of air flow and through which a fluid is allowed to flow, a group of cutouts being formed on tabular fin surfaces and between adjacent those of said fins, projecting in the direction of arrangement of said fins, wherein:

said group of cutouts are divided into an upstream-side subgroup and a downstream-side subgroup, as viewed in the direction of the air flow, with a line passing through the center of each of said tubes serving as a boundary therebetween, and a central flat portion is provided which is located on said center line and between said upstream-side subgroup and said downstream-side subgroup;

said upstream-side subgroup of cutouts include three rows of cutouts which are disposed on a central side located close to said center line, on an outer side located on said upstream side, and on an intermediate side located between said central side and said outer side;

each of said cutouts in each of said rows is formed by a pair of rising portions whose ends project from said fin surface as well as a bridging portion spanning said rising portions, said cutouts being formed such as to project alternately on the front side and the rear side of said fin surface;

an intermediate flat portion is formed between adjacent those of said cutouts, said cutouts being arranged parallel with each other with said intermediate flat portion placed therebetween;

each of said rising portions which are adjacent to said tubes among said rising portions of said cutouts is located on a line substantially parallel with a line tangential to an outer periphery of said tube;

each of said cutouts on said central side and said intermediate side is formed into the shape of a trapezoid with equal legs, two parallel sides thereof being perpendicular to the main direction of said air flow, the short side of each of said trapezoids with equal legs being arranged such as to be located on the center line side;

said outer-side cutout is constituted by a pair of parallelogrammic medium-size cutouts which are obtained by separating a cutout having the shape of said trapezoid with equal legs into two, and a dividing flat portion is provided between said medium-size cutouts;

said rising portions of said pair of medium-size cutouts that are respectively disposed on both sides of said dividing flat portion are oriented in such a manner that an interval therebetween becomes smaller toward the leeward side in said main direction of air flow; and said leeward-side subgroup of cutouts includes a plurality of cutouts.

2. A heat exchanger according to claim 1, wherein said leeward-side subgroup of cutouts is formed symmetrically with a windward-side subgroup of cutouts about said center line.

3. A heat exchanger according to claim 1, wherein said leeward-side subgroup of cutouts include three rows of cutouts which are disposed on a central side located close to said center line, on an outer side located on said upstream side, and on an intermediate side located between said central side and said outer side;

each of said cutouts is formed by a pair of rising portions whose ends project from said fin surface as well as a bridging portion spanning said rising portions, said cutouts being formed such as to project alternately on the front side and the rear side of said fin surface;

an intermediate flat portion is formed between adjacent those of said cutouts, said cutouts being arranged parallel with each other with said intermediate portion placed therebetween;

each of said rising portions which are adjacent to said tubes among said rising portions of said cutouts is located on a line parallel with a line substantially tangential to an outer periphery of said tube;

each of said cutouts on said central side, said intermediate side, and said outer side is formed into the shape of a trapezoid with equal legs, two parallel sides thereof being perpendicular to the main direction of said air flow, the short side of each of said trapezoids with equal legs being arranged such as to be located on the center line side;

said intermediate-side cutout is constituted by a pair of parallelogrammic medium-size cutouts which are obtained by separating a cutout having the shape of said trapezoid with equal legs into two, and a dividing flat portion is provided between said medium-size cutouts;

said rising portions of said pair of medium-size cutouts that are respectively disposed on both sides of said dividing flat portion are oriented in such a manner that an interval therebetween becomes smaller toward the windward side in said main direction of air flow;

said outer-side cutout includes three divided members composed of two small parallelogrammic cutouts obtained by dividing a cutout having the shape of said trapezoid with equal legs into two and a small cutout having the shape of a trapezoid with equal legs which is placed between said two small parallelogrammic cutouts, a small dividing flat portion being provided in two intermediate portions which are dividing portions, and said small parallelogrammic cutouts and said small cutouts having the shape of said trapezoid with equal legs are arranged in such a manner that the parallelism between said rising portions provided on both sides of said small dividing flat portion is maintained and the long sides of said small cutouts having the shape of said trapezoid with equal legs are oriented such as to be located on the upper leeward side in said main direction of air flow.

4. A heat exchanger having a plurality of tabular fins which are arranged in parallel at fixed intervals and through which the air is allowed to flow and a plurality of tubes which are inserted in each of said tabular fins at a right angle therewith and disposed in the direction of air flow and perpendicular to the direction of said flow and through which a fluid is allowed to flow, a group of cutouts being formed on tabular fin surfaces and between adjacent those of said fins, projecting in the direction of arrangement of said fins, wherein:

said group of cutouts are divided into an upstream-side subgroup and a downstream-side subgroup, as viewed in the direction of the air flow, with a line passing through the center of said tubes of each row serving as a boundary therebetween, and a central flat portion is provided which is located on said center line and between said upstream-side subgroup and said downstream-side subgroup;

said upstream-side subgroup of cutouts in an upstream-side row include three rows of cutouts which are disposed on a central side located close to said center line, on an outer side located on said upstream side, and on an intermediate side located between said central side and said outer side;

each of said cutouts in each of said rows is formed by a pair of rising portions whose ends project from said fin surface as well as a bridging portion spanning said rising portions, said cutouts being formed such as to project alternately on the front side and the rear side of said fin surface;

an intermediate flat portion is formed between adjacent those of said cutouts, said cutouts being arranged parallel with each other with said intermediate portion placed therebetween;

each of said rising portions which are adjacent to said tubes among said rising portions of said cutouts is located on a line substantially parallel with a line tangential to an outer periphery of said tube;

each of said cutouts on said central side and said intermediate side is formed into the shape of a trapezoid with equal legs, two parallel sides thereof being perpendicular to the main direction of said air flow, the short side of the two parallel sides of each said trapezoid with equal legs being arranged such as to be located on the center line side;

said outer-side cutout is constituted by a pair of parallelogrammic medium-size cutouts which are obtained by separating a cutout having the shape of said trapezoid with equal legs into two, and a dividing flat portion is provided between said medium-size cutouts;

said rising portions of said pair of medium-size cutouts that are respectively disposed on both sides of said dividing flat portion are oriented in such a manner that an interval therebetween becomes smaller toward the leeward side in said main direction of air flow;

said leeward-side subgroup of cutouts in a upstream-side row is formed symmetrically with said windward-side group of cutouts about said center line;

said leeward-side subgroup of cutouts in a downstream-side row include three rows of cutouts which are disposed on a central side located close to said center line, on an outer side located on said upstream side, and on an intermediate side located between said central side and said outer side;

each of said cutouts in each of said rows is formed by a pair of rising portions whose ends project from said fin surface as well as a bridging portion spanning said rising portions, said cutouts being formed such as to project alternately on the front side and the rear side of said fin surface;

an intermediate flat portion is formed between adjacent ones of said cutouts, said cutouts being arranged parallel with each other with said intermediate portion placed therebetween;

each of said rising portions which are adjacent to said tubes among said rising portions of said cutouts is located on a line substantially parallel with a line tangential to an outer periphery of said tube;

each of said cutouts on said central side, said intermediate side, and the outside is formed into the shape of a trapezoid with equal legs, two parallel sides thereof being perpendicular to the main direction of said air flow, the short side of each said trapezoid with equal legs being arranged such as to be located on the center line side;

said outer-side cutout is constituted by a pair of parallelogrammic medium-size cutouts which are obtained by separating a cutout having the shape of said trapezoid with equal legs into two, and a dividing flat portion is provided between said medium-size cutouts;

said rising portions of said pair of medium-size cutouts that are respectively disposed on both sides of said dividing flat portion are oriented in such a manner that an interval therebetween becomes smaller toward the leeward side in said main direction of air flow;

said outer-side cutout includes three divided members composed of two small parallelogrammic cutouts obtained by dividing a cutout having the shape of said trapezoid with equal legs into two and a small cutout having the shape of a trapezoid with equal legs which is placed between said two small parallelogrammic cutouts, a small dividing flat portion being provided in two intermediate portions which are dividing portions;

said small parallelogrammic cutouts and said small cutouts having the shape of said trapezoid with equal legs are arranged in such a manner that the parallelism between said rising portions provided on both sides of said small dividing flat portion is maintained and the long sides of said small cutouts having the shape of said trapezoid with equal legs are oriented such as to be located on the upper leeward side in said main direction of air flow; and a lower windward subgroup of said cutouts in said downstream-side row include a plurality of cutouts.

5. A heat exchanger according to claim 4, wherein the positional relationships of said respective tubes with respect to said upstream-side row and said downstream-side row are arranged in such a manner that said cutouts in said upstream-side row and said downstream-side row do not overlap with each other.

6. A heat exchanger according to claim 4, wherein said windward-side subgroup of cutouts in said downstream-side row are formed symmetrically with said leeward-side subgroup of cutouts with respect to said center line in said downstream-side row.

7. A heat exchanger according to claim 5, wherein said windward-side subgroup of cutouts in said downstream-side row are formed symmetrically with said leeward-side subgroup of cutouts with respect to said center line in said downstream-side row.

8. A heat exchanger having a plurality of tabular fins which are arranged in parallel at fixed intervals and through which the air is allowed to flow and a plurality of tubes which are inserted in each of said tabular fins at a right angle therewith and disposed on the windward side and leeward side of air flow in the direction of the air flow and perpendicular to the direction of air flow, and through which a fluid is allowed to flow, a plurality of groups of cutouts being formed on tabular fin surfaces and between adjacent those of said tubes in the direction of arrangement of said fins, wherein the positional relationships of said respective tubes with respect to said upstream-side row and said downstream-side row are arranged in such a manner that said cutouts in said upstream-side row and said downstream-side row do not overlap:

said group of cutouts are divided into an upstream-side subgroup and a downstream-side subgroup, as viewed in the direction of the air flow, with a line passing through the center of said tubes of each row serving as a boundary therebetween, and a central flat portion is provided which is located on said center line and between said upstream-side subgroup and said downstream-side subgroup;

said upstream-side group of cutouts include three rows of cutouts which are disposed on a central side located close to said center line, on an outer side located on said upstream side, and on an intermediate side located between said central side and said outer side;

each of said cutouts is formed by a pair of rising portions whose ends project from said fin surface as well as a bridging portion spanning said rising portions, said cutouts being formed such as to project alternately on the front side and the rear side of said fin surface;

an intermediate flat portion is formed between adjacent those of said cutouts, said cutouts being arranged parallel with each other with said intermediate portion placed therebetween;

each of said rising portions which are adjacent to said tubes among said rising portions of said cutouts is located on a line parallel with a line tangential to an outer periphery of said tube;

each of said cutouts on said central side and said intermediate side is formed into the shape of a trapezoid with equal legs, two parallel sides thereof being perpendicular to the main direction of said air flow, the short side of the two parallel sides of each said trapezoid with equal legs being arranged such as to be located on the center line side;

said outer-side cutout is constituted by a pair of parallelogrammic medium-size cutouts which are obtained by separating a cutout having the shape of said trapezoid with equal legs into two, and a dividing flat portion is provided between said medium-size cutouts;

said rising portions of said pair of medium-size cutouts that are respectively disposed on both sides of said dividing flat portion are oriented in such a manner that an interval therebetween becomes smaller in said main direction of air flow toward the leeward side;

said upstream-side group of cutouts include three rows of cutouts which are disposed on a central side located close to said center line, on an outer side located on said upstream side, and on an intermediate side located between said central side and said outer side;

each of said cutouts is formed by a pair of rising portions whose ends project from said fin surface as well as a bridging portion spanning said rising portions, said cutouts being formed such as to project alternately on the front side and the rear side of said fin surface;

an intermediate flat portion is formed between adjacent those of said cutouts, said cutouts being arranged parallel with each other with said intermediate portion placed therebetween;

each of said rising portions which are adjacent to said tubes among said rising portions of said cutouts is located on a line parallel with a line tangential to an outer periphery of said tube;

each of said cutouts on said central side, said intermediate side and said outside is formed into the shape of a trapezoid with equal legs, two parallel sides thereof being perpendicular to the main direction of said air flow, the short side of each of said trapezoids with equal legs being arranged such as to be located on the side of said center line;

said outer-side cutout on said intermediate side is constituted by a pair of parallelogrammic medium-size cutouts which are obtained by separating a cutout having the shape of said trapezoid with equal legs into two, and a dividing flat portion is provided between said mediumsize cutouts;

said rising portions of said pair of medium-size cutouts that are respectively disposed on both sides of said dividing flat portion are oriented in such a manner that an interval therebetween becomes smaller in said main direction of air flow toward the leeward side;

said outer-side cutout includes three divided composed of two small parallelogrammic cutouts obtained by dividing a cutout having the shape of said trapezoid with equal legs into two and a small cutout having the shape of a trapezoid with equal leqs which is placed between said two small parallelogrammic cutouts, a small dividing flat portion being provided in two intermediate portions which are dividing portions;

said small parallelogrammic cutouts and said small cutouts having the shape of said trapezoid with equal legs are arranged in such a manner that the parallelism between said rising portions provided on both sides of said small dividing flat portion is maintained and the long sides of said small cutouts having the shape of said trapezoid with equal legs are oriented such as to be located on the upper leeward side in said main direction of air flow; and said windward-side subgroup of cutouts in a upstream-side row is formed symmetrically with said leeward-side group of cutouts about said center line of said heat transfer tube, in said downstream side room.

* * * * *